United States Patent [19]

Dannatt

[11] 4,266,115

[45] May 5, 1981

[54] HOT ROLL FUSING DEVICE

[75] Inventor: Hugh St. L. Dannatt, Bethel, Conn.

[73] Assignee: Pitney Bowes Inc., Stamford, Conn.

[21] Appl. No.: 41,025

[22] Filed: May 21, 1979

[51] Int. Cl.[3] ..... H05B 3/10

[52] U.S. Cl. ..... 219/216; 219/469; 219/505; 338/22 SD

[58] Field of Search ..... 355/3 R, 3 FU, 14 FU; 219/216, 469, 470, 471, 504, 505; 338/22 R, 22 SD; 432/60, 228

[56] References Cited

U.S. PATENT DOCUMENTS

| | | | |
|---|---|---|---|
| 3,401,439 | 9/1968 | Staats et al. | 219/469 X |
| 3,562,489 | 2/1971 | Lenk | 219/469 |
| 3,582,968 | 6/1971 | Buiting et al. | 219/505 X |
| 3,632,971 | 1/1972 | Flanagan | 219/222 |
| 3,645,785 | 2/1972 | Hentzschel | 338/22 SD X |
| 3,720,808 | 3/1973 | Morrissey | 219/469 |
| 4,109,135 | 8/1978 | Minden et al. | 219/469 X |

*Primary Examiner*—Fred L. Braun

*Attorney, Agent, or Firm*—Melvin J. Scolnick; William D. Soltow, Jr.; Albert W. Scribner

[57] ABSTRACT

A heated fuser roll for use in a fusing apparatus for fixing toner images to a support surface. The fuser roll includes an electrically conductive core member having a plurality of axially disposed longitudinal channels lying along the outer surface of the core member, and a heating element formed of a semiconducting ceramic material having a positive temperature coefficient of resistivity and exhibiting a Curie temperature transition point at which the resistance of the material increases with increasing temperature positioned in each of the channels. A layer of a thermally conductive material covers the outer exposed surfaces of both the core member and heating elements, and a sleeve member is positioned around the thermally conductive material.

16 Claims, 3 Drawing Figures

HOT ROLL FUSING DEVICE

BACKGROUND OF THE DISCLOSURE

I. Field of the Invention

This invention relates to a heated fuser device as is commonly used in xerographic copying machines, and more particularly to a heated fuser roll whose heating elements are axially disposed along the roll and are formed of a material that enables the fuser to be temperature-self regulating.

II. Description of the Prior Art

In a typical xerographic process a photoconductor comprising a photoconductive composition coated on a rigid or flexible substrate is uniformly electrostatically charged in the dark, and then exposed by being illuminated in an image pattern in accordance with graphic material on an original document. The photoconductor becomes discharged in the areas exposed to the illumination, but retains its electrostatic charge in the dark areas, which areas correspond to the graphic material on the original document. The resulting electrostatic latent image is developed by depositing on the photoconductor a finely divided electrostatically attractable developing material (toner). The toner will normally be attracted to those areas on the photoconductor which retain a charge, thereby forming a toner image corresponding to the electrostatic latent image. This visible image of developing material is then transferred to a support surface, such as plain paper or any other suitable substrate, to become the ultimate copy. Any residual developing material remaining on the photoconductor is cleaned and the photoconductor is reused as described above for subsequent copies. The toner image that was transferred to the plain paper is then fixed thereto. Since the developing material is heat fusible, application of sufficient heat to the paper causes the developing material to melt and be fused into the paper so as to be permanently affixed thereto.

One very basic approach to fusing in a xerographic copying machine is the use of the so-called hot roll pressure fuser apparatus. Typically, in this apparatus, the paper with the toner image thereon is passed between a pair of opposed rollers, at least one of which is heated. Generally, the heated roll is formed of a hollow cylinder having a radiant heater, such as an infrared lamp or a halogen lamp, centrally located within the cylinder to heat the roll, in series with a bimetal thermostat. A typical example of this type of heated fuser roll is illustrated in U.S. Pat. No. 3,637,976. During operation of the fusing apparatus, the paper to which the toner images are electrostatically adhered is passed through the nip formed between the rolls with the toner image contacting the fuser roll to effect heating of the toner image within the nip. Fusing is enhanced by the second roll or pressure roll as it is commonly called as the result of a biasing force which forces the rolls into engagement. The thermostat intermittently interrupts the current flow as the roll temperature reaches a predetermined value. The roll then cools to some lower temperature whereupon the thermostat restores the current, and the roll heats up again.

Many of the problems that occur with the use of a hot roll-pressure fusing apparatus are in the heated fusing roll. In particular, these problems relate to the means employed for heating the fuser roll and its control. For example, in many of the known hot-roll fusers it is extremely difficult to maintain a constant temperature at the nip of the rollers where the actual fusing of the toner occurs, and where temperature control is critical. Temperature control is difficult because (1) it is difficult to sense the temperature in this region: (2) thermal lag, i.e., the responsiveness of roll temperature under varying demands of thermal output; and (3) there are both different machine modes, i.e., standby, off, continuous operation, and different size papers to contend with. The type of thermostat control as described above is conspicuously oscillatory in nature. The thermostat, by necessity being situated on the circumference of the roll in order to control the temperature of that surface, is relatively remote from the heater and, thus, the temperature fluctuations are usually significant. Reductions in this aforesaid differential temperature characteristic requires extensive and expensive proportional feedback control means. In addition to these problems, radiant-type heated fuser rolls generally require very high heating temperatures for the heating element to enable the roll temperature in the nip of the rollers to be high enough to melt the toner. The use of these high temperatures can result in deterioration of the fuser roll.

Examples of other miscellaneous type heated rolls exhibiting many of the problems as outlined above are illustrated in U.S. Pat. Nos. 3,471,683, 3,720,808 and 4,100,397.

SUMMARY OF THE INVENTION

It is therefore an object of the present invention to overcome many of the disadvantages of the hot roll fusers described in the prior art and to provide a hot roll fuser that is temperature-self regulating and will permit relatively simple control of the temperature of the roll in the critical area where fusing occurs.

It is a further object of this invention to provide a hot roll fuser which will provide a relatively even temperature gradient along its surfaces, avoid large temperature fluctuations, and eliminate center to edge temperature differentials.

It is a further object of the invention to avoid the use of high temperature heating elements for heating a fuser roll thereby avoiding deterioration of the fuser roll.

The foregoing objects and others are accomplished in accordance with the present invention by providing a heated fuser roll for use in a fusing apparatus for fixing toner images to a support surface, the fuser roll comprising an electrically conductive core member including a plurality of axially disposed longitudinal channels lying along the outer surface of the core member; a heating element formed of a semiconducting ceramic material having a positive temperature coefficient of resistivity and exhibiting a Curie temperature transition point at which the resistance of the material increases with increasing temperature positioned in each of the channels; a layer of a thermally conductive material covering the outer exposed surfaces of both the core member and the heating elements; and a sleeve member positioned around the thermally conductive material.

The present invention relates to the application of ceramic heating elements of a class known as positive temperature coefficient materials (PTC) which are axially disposed in channels that are along the outer surface of the core of the roll. The preferred ceramic material is described as ferroelectric and has the property of possessing low resistance up to some characteristic temperature known as the Curie temperature. Upon attaining this temperature, the electrical resistance of the ceramic material increases typically from 50 ohms to 5000 ohms or more within a span of less than ten (10) degrees centigrade. It is thus to be appreciated that such a material may be configured to furnish its own thermostat, and furthermore since the effect is internal, pronounced and confined to a narrow temperature band, the oscillatory variations of temperature may be minimized. Such a system has advantages over the conventional and known methods of control. A heated fuser roll having the structure as herein described leads to superior control, the elimination of a conventional thermostat and therefore a more economical device. This also leads to a more reliable device since thermostats are somewhat prone to contact failure. The elimination of a conventional thermostat also eliminates possible electrical interference effects. The self-limiting feature of the heating elements used in the roll eliminates temperature overshoot and promotes rapid heat up.

BRIEF DESCRIPTION OF THE DRAWINGS

For a better understanding of the invention as well as other objects and further features thereof, reference is made to the following detailed disclosure of this invention taken in conjunction with the accompanying drawings wherein.

DESCRIPTION OF THE PREFERRED EMBODIMENTS

Figure 1:
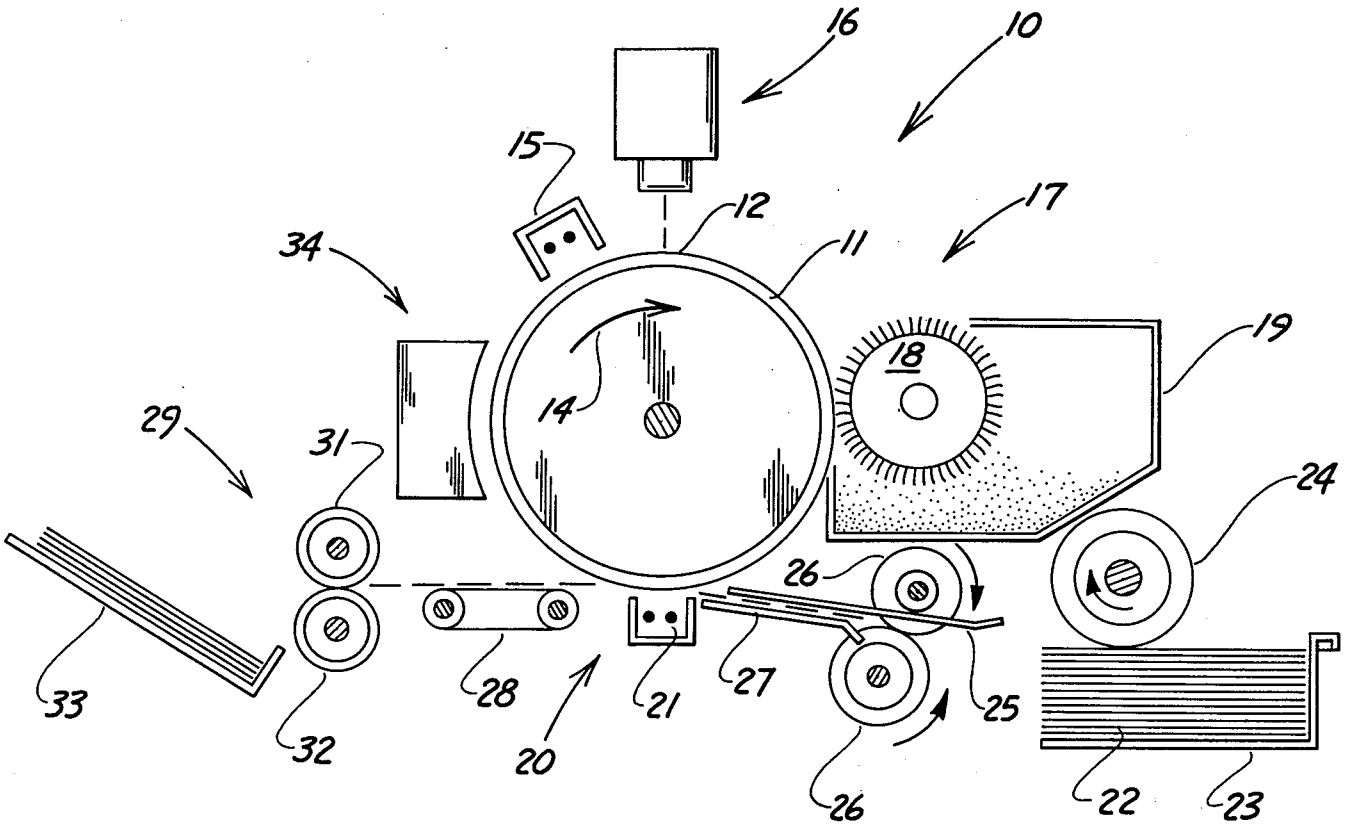
FIG. 1 is a schematic sectional view of a copier.

Referring now to the drawings and particularly to FIG. 1 thereof, there is shown an electrophotographic copying machine employing a fusing device in which a heated fuser roll in accordance with the present invention can be utilized. The various processing stations shown in FIG. 1 will be represented in part as blocks and the processing stations will only be briefly described. The particular copying machine illustrated in FIG. 1 is merely exemplary as far as the present invention is concerned for a complete understanding of an xerographic process and, in particular, how a fusing apparatus is employed in such a process. A fusing apparatus employing a heated fuser roll in accordance with the present invention may be utilized in a wide variety of devices including coated paper copiers and plain paper copiers, and is not necessarily limited to the particular type of copier system shown in FIG. 1.

In FIG. 1, the reference numeral 10 generally designates an electrophotographic copying machine which includes a rotating drum 11 having a photoconductive surface 12 secured around the outer surface of the drum. Any of the numerous inorganic or organic photoconductive materials can be employed, such as for example, a selenium alloy. Additionally, the photoconductor can be in the form of a belt instead of a drum. As drum 11 rotates in the direction of arrow 14, it passes through the various processing stations disposed around the periphery of the drum.

First, drum 11 rotates a portion of photoconductive surface 12 through a charging apparatus which includes a corona generating device 15 that is positioned closely adjacent the surface of the photoconductor. Corona generating device 15 imparts a uniform electrostatic charge to photoconductor surface 12.

An image of the document to be copied is transmitted to photoconductor surface 12 by the exposure and imaging station generally designated 16. This station could, for example, include a reciprocating carriage that is movably mounted on top of the copying machine cabinet. The carriage would include a transparent platen on which documents are placed face down for copying. Overlying the platen would be a movable cover connected to one side of the carriage. An operator can raise and lower the cover and thereby place on or remove documents from the platen. A series of lamps would be used to illuminate the original document. By incorporating an optical system comprising mirrors and lenses a light image of the original document to be copied is projected onto the charged portion of photoconductive surface 12. The movement of the carriage and therefore the scanning of the original document is in timed relationship with the movement of rotating drum 11. Thus photoconductive surface 12 is selectively exposed to dissipate the charge thereon and record an electrostatic latent image corresponding to the indicia on the original document.

As drum 11 rotates, the latent image on photoconductive surface 12 is carried past a developer station 17. The developer material used can, for example, be a two component developer which comprises carrier particles having toner particles adhering thereto. The carrier particles are formed of a magnetic material while the toner particles are usually a heat settable plastic. However, a single component toner can also be used. Preferably a magnetic brush developing unit is used in which a rotating magnetic roll 18 picks up toner from a hopper 19 to form a rotating magnetic brush, and carries that toner into contact with the latent image on photoconductive surface 12. The charged or latent image areas of the photoreceptor electrostatically attracts and holds the toner particles, thus developing the latent image.

Transfer station 20 includes a corona transfer charging apparatus 21. In timed relationship with the arrival of the developed image at transfer corona 21, a copy sheet also arrives at transfer station 20. The copy sheet is fed from a supply of sheets 22 stored in removable tray 23. A feed roller 24 feeds the uppermost copy sheet from the supply 22, through paper guide 25 and into the nip of queuing rollers 26. At a predetermined time in the course of a copy cycle, the queuing rollers 26 are actuated to feed the copy sheet along paper guide 27 and into contact with the developed image carried on photoreceptor surface 12. By virtue of the electric charge that is generated by transfer corona 21, toner particles are attracted from photoreceptor surface 12 toward the copy sheet to which they loosely adhere. After transferring the toner powder to the copy sheet, the sheet is stripped away from drum 11 by a suitable apparatus, and advanced by, belt conveyor 28 to fixing station 29.

The copy sheet then passes into fixing station 29 which includes a fusing apparatus in which the toner material now residing on the copy paper is heated to a temperature at which the toner particles melt and are thereby fused into the copy paper so as to form a permanent copy of the original document. An example of a fusing apparatus including a heated fuser roll that forms the basic subject matter of the present invention is illustrated in its operative position in FIG. 1. As shown, the fuser apparatus includes a heated fuser member or roll 31, and a backup member or roll 32. The copy sheet with the toner powder image thereon is interposed between fuser roll 31 and backup roll 32. A release material, e.g. polytetra-fluoroethylene, can be on the fuser roll to prevent offset and allow for easy release of the paper from the roll. After the toner image is permanently affixed to the copy sheet, the sheet is separated from the fuser roll and advanced to a catch tray 33 for subsequent removal from the copier by an operator.

In order to remove residual toner particles which adhere to photoconductive surface 12 after the transfer of the powder image to the copy sheet, copying machine 10 is provided with a cleaning system generally designated by reference number 34. The cleaning mechanism can, for example, include a corona generating device and a brush which contacts photoconductive surface 12. First, the remaining toner particles are brought under the influence of the corona generating device to neutralize the electrostatic charge remaining on photoconductive surface 12 and that of the residual toner particles. Thereafter, the neutralized particles are removed from surface 12 by the rotatably mounted brush. After the cleaning operation, a discharge lamp can be used to discharge remaining charges on surface 12 prior to the recharging thereof at corona device 15 for the next copying cycle.

Figures 2, 3:
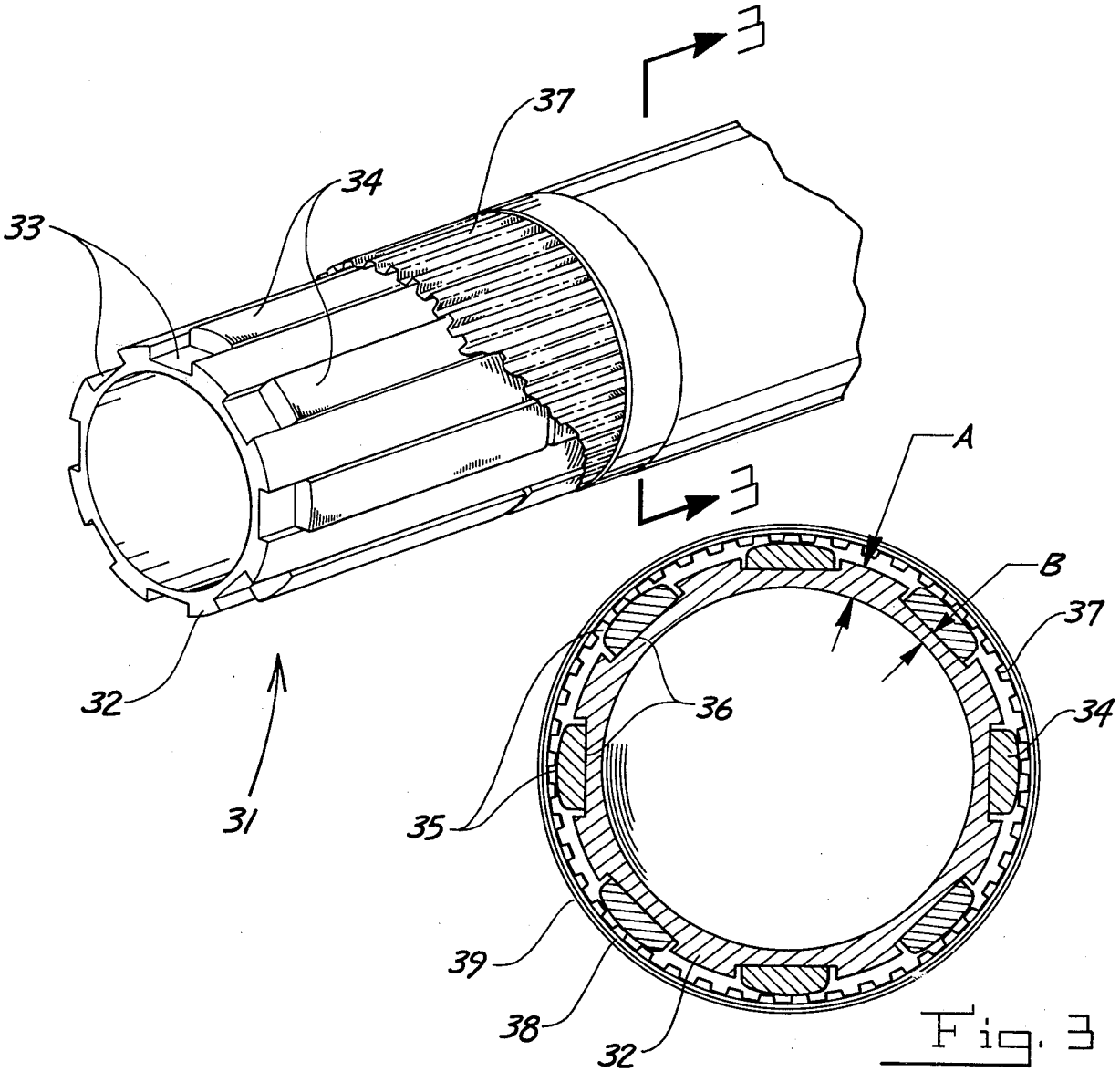
FIG. 2 is an exploded prespective view of a portion of a preferred embodiment of a heated fuser roll in accordance with the present invention.
FIG. 3 is a cross sectional view taken along line 3—3 of FIG. 2.

Referring now to the specific subject matter of the present invention, there is illustrated in FIGS. 2 & 3 a preferred embodiment of a heated fuser roll 31 in accordance with the features of the present invention. The structure of fuser roll 31 is in the form of a hollow circular cylinder and includes a metallic core 32. The outer surface of core 32 includes a plurality of axially disposed longitudinal channels 33 which lie substantially parallel to each other. As an example of the physical dimensions of a preferred embodiment of a core in accordance with the present invention, the thickness of A can be approximately 0.10" and the thickness of B about 0.050". Core 32 is preferably an extruded structure that is formed of a metal exhibiting both excellent electrical and thermal conductivity properties so that it could properly distribute (i) electric current to heating elements 34 and (ii) the heat generated by the heating elements evenly to the working surface of the fuser. Examples of some of the metals which could be used to manufacture the core include aluminum, copper and brass.

Located within each of channels 33 is a heating element 34. Heating elements 34 are formed of a semiconducting ceramic material which has a positive temperature coefficient of resistivity and exhibits a Curie temperature transition point at which the resistance of the material increases with increasing temperature. The preferred semiconducting ceramic materials embodied within the present invention have a Curie temperature or transition temperature such that when the material reaches its particular Curie temperature the resistance of these materials increases by several powers of ten. These materials, when employed as heating elements 34, impart to fuser roll 31 the ability to operate as a self-regulating heat source. At a given voltage heating elements 34 will draw a high current. This is because the elements are cold and their resistance is low. Within a few seconds the Curie temperature of the ceramic material is reached, there is a sharp increase in resistance, e.g. from 50 ohms to 5,000 ohms, and an immediate restriction in the amount of power absorbed. Thereafter a state of equilibrium arises in which the power absorbed adjusts itself such that it is equal to the heat dissipated. Thus, the material tends to keep its temperature substantially in the vicinity of the Curie temperature. The particular ceramic material composition that is chosen for use as the heating element, of course, depends upon the fusing temperature requirements. In accordance with the present invention, ceramic semiconducting materials that exhibit Curie temperatures within the range of about 150° C. to about 220° C. are the preferred materials for use as heating elements 34. Compositions comprising barium titanate with strontium titanate and/or lead titanate, and a small amount of lanthanum in the form of lanthanum titanate, e.g. 0.3 mol %, (lanthanum is added in sufficient amount to impart semiconductive properties to the material) are particularly well suited as compositions for heating elements 34. Details of these ceramic materials as heating elements for fusers can be found in commonly assigned and copending U.S. patent application entitled "Temperature-Self Regulating Fuser" by Donald T. Dolan, Ser. No. 041,024, filed May 21, 1979).

One preferred embodiment for heating elements 34 is as shown in FIGS. 2 & 3, i.e. elongated rods having a substantially rectangular cross section. There can be several heating elements in each channel 33 (as shown) or only one elongated heating element. An example of the preferred physical dimensions of the heating elements cross section in accordance with the present invention would be 0.125" (height) by 0.4" width. The upper surfaces 35 of heating elements 34 are preferably at a higher radial elevation than the upper surface of core 32, as shown in FIGS. 2 and 3, to prevent a short circuit during operation of the fuser.

The upper and lower surfaces 35 and 36 respectively of each of heating elements 34 are preferably coated with a metal coating of a sufficient thickness to achieve intimate electrical and thermal contact between the heating elements and its surrounding structure and to withstand thermal stress. A coating thickness ranging from about 0.0005" to about 0.005" of a material such as silver or aluminum is preferred. These coatings can be placed on heating elements 34 by, for example, a vacuum deposition process or suitable silk screening process. These metal coatings also help to provide uniform and rapid distribution of the heat from the heating elements to the working surface of the fuser.

Covering the outer exposed surfaces of both core 32 and heating elements 34 is a layer 37 the function of which is to establish good thermal contact between heating elements 34 and the outer work surface of fuser roll 31. Although numerous kinds of materials can be employed for this purpose, such as metallic layers and elastomers, it has been found that metallic foils are eminently suited. Metal foils made of copper or brass having a thickness of about 0.001" to about 0.003" are especially preferred. It is also preferred to use a material for layer 37 which has sufficient resilience to withstand the repeated thermal cycles caused by the heating elements, and at the same time remain in contiguous relation with core 32, heating elements 34 and sleeve 38. When using a metal foil for layer 37, the foil can be corrugated as shown in FIGS. 2 and 3 to allow it to withstand these thermal cycles.

Sleeve member 38 preferably formed of a material having high thermal conductivity characteristics, such as for example, aluminum, brass or copper contains core 32, heating elements 34 and foil layer 37, and provides the basic work surface for heated fuser roll 31. Sleeve member 38 is provided with an outer layer 39 of a material which will help prevent offsetting or sticking of the toner to the roll as the roll rotates in contact with the toner. For example, outer layer 39 can be fabricated of a polytetrafluoro-ethylene material (e.g. Teflon) or a silicone elastomer coated with silicone oil as well as silicone elastomers containing low surface energy fillers such as fluorinated organic polymers, and the like.

While this invention has been described in conjunction with a specific embodiment thereof, it is evident that many alternatives, modifications and variations will be apparent to those skilled in the art. Accordingly, the present invention is intended to embrace all such alternatives, modifications and variations which fall within the spirit and scope of the appended claims.

I claim:

1. A heated fuser roll for use in a fusing apparatus for fixing toner images to a support surface, said fuser roll comprising:

an electrically conductive core member including a plurality of axially disposed longitudinal channels lying along the outer surface of said core member;

a heating element formed of a semiconducting ceramic material having a positive temperature coefficient of resistivity and exhibiting a Curie temperature transition point at which the resistance of said material increases with increasing temperature positioned in each of said channels;

a layer of a thermally conductive material covering the outer exposed surfaces of both said core member and said heating elements; and a sleeve member positioned around said thermally conductive material, said thermally conductive material being in a resilient form to withstand repeated thermal cycles and remain in contiguous contact with said core member, heating elements and sleeve member.

2. A roll according to claim 1 wherein both the upper and lower surfaces of each of said heating elements are coated with a metal.

3. A roll according to claim 2 wherein said metal coated on said heating elements is silver or aluminum.

4. A roll according to claim 1 wherein said heating elements have a rectangular cross section.

5. A roll according to claim 1 wherein each channel contains a plurality of heating elements.

6. A roll according to claim 1 wherein said ceramic material exhibits a Curie temperature ranging from about 150° C. to about 220° C.

7. A roll according to claim 6 wherein said ceramic material comprises barium titanate, strontium titanate and/or lead titanate, and lanthanum.

8. A roll according to claim 1 wherein the upper surface of said heating element is at a higher radial elevation than the upper surface of said core.

9. A roll according to claim 8 wherein said thermally conductive material is a metallic foil.

10. A roll according to claim 9 wherein said metallic foil is corrugated.

11. A roll according to claim 9 wherein the thickness of said metallic foil is in the range of about 0.001" to about 0.003".

12. A roll according to claim 9 wherein said metallic foil is made of copper or brass.

13. A roll according to claim 1 wherein said core is made of aluminum, copper, or brass.

14. A roll according to claim 1 wherein said sleeve is made of aluminum, copper or brass.

15. A roll according to claim 1 further comprising an outer layer of silicone rubber covering said sleeve.

16. A roll according to claim 1 further comprising an outer layer of polytetra-fluoroethylene covering said sleeve.

* * * * *